US005899762A

United States Patent [19]

Ainceri

[11] Patent Number: 5,899,762

[45] Date of Patent: May 4, 1999

[54] ELECTRICAL CONNECTOR HAVING AN INSERTION AND EXTRACTION SLIDE

[75] Inventor: Rachid Ainceri, Chartres, France

[73] Assignee: Framatome Connectors International, Courbevoie, France

[21] Appl. No.: 08/594,397

[22] Filed: Jan. 31, 1996

Related U.S. Application Data

[63] Continuation of application No. 08/246,425, May 20, 1994, abandoned.

[30] Foreign Application Priority Data

May 21, 1993 [FR] France ..... 93 06122

[51] Int. Cl.[6] ..... H01R 13/629

[52] U.S. Cl. ..... 439/157; 439/347

[58] Field of Search ..... 439/152–160, 439/345, 347, 352, 372

[56] References Cited

U.S. PATENT DOCUMENTS

| | | | |
|---|---|---|---|
| 4,586,771 | 5/1986 | Kraemer et al. | 339/75 |
| 5,183,408 | 2/1993 | Hatagishi | 439/157 |
| 5,205,753 | 4/1993 | Butterfield et al. | 439/157 |
| 5,207,593 | 5/1993 | Bogiel | 439/345 |

FOREIGN PATENT DOCUMENTS

| | | |
|---|---|---|
| 1515906 | 11/1965 | Germany . |
| 4228531 | 8/1992 | Germany . |
| 9305859 | 9/1992 | Germany . |

*Primary Examiner*—Gary Paumen
*Assistant Examiner*—Tho Dac Ta
*Attorney, Agent, or Firm*—Pollock, Vande Sande & Amernick

[57] ABSTRACT

A rectangular electrical connector comprises a receptacle having two side walls that define two parallel passages extending in the longer direction of the receptacle and a plug displaceable with respect to the receptacle in an insertion direction. A U-shaped slide for forced insertion and extraction of the plug slides along the passages orthogonally to the insertion direction. It is formed with open-ended grooves for receiving studs projecting from the plug orthogonally to the insertion direction, having a shape such that displacement of the slide in a first direction causes the studs to move along the grooves from the open ends thereof, and displacement in the opposite direction forces the studs out of the grooves. The slide has resilient retaining lugs that project outwardly from the slide when at rest. Cut-outs are formed in the side wall of the receptacle to receive the lugs and are of a length enabling to fully insert the slide but preventing full extraction of the slide. The lugs have a shape such that the force required for pulling the slide out of the receptacle is much greater than the force required for inserting it into the receptacle.

12 Claims, 2 Drawing Sheets

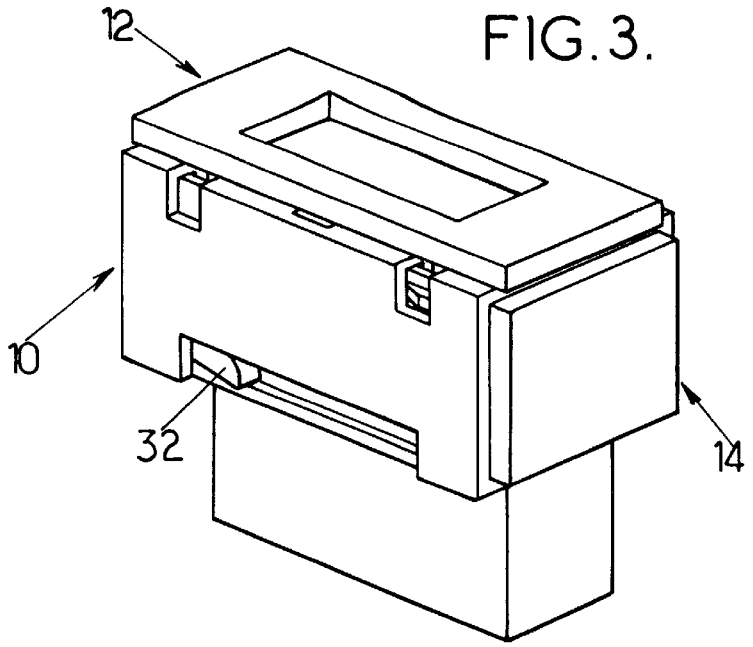
FIG. 3.
FIG. 4.
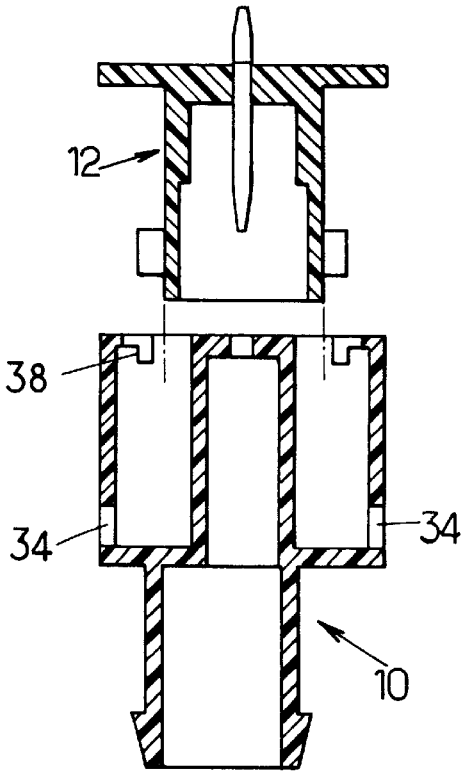
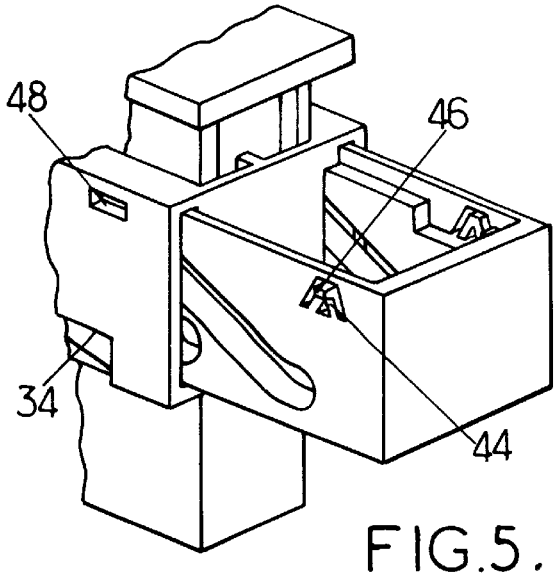
FIG. 5.

ELECTRICAL CONNECTOR HAVING AN INSERTION AND EXTRACTION SLIDE

This application is a continuation of application Ser. No. 08/246,425 filed May 20, 1994 and now abandoned.

BACKGROUND OF THE INVENTION

The present invention relates to a rectangular electrical connector of the type comprising:

- a receptacle receiving first electrical contacts, having two side walls that define two parallel passages extending in the longer direction of the receptacle,
- a plug receiving second contacts for cooperation with the first contacts, the plug being displaceable with respect to the receptacle in an insertion and extraction direction, the plug having studs projecting orthogonally to the insertion and extraction direction; and
- a U-shaped slide for forced insertion and extraction of the plug, the slide being arranged for sliding along the passages orthogonally to the insertion and extraction direction, being formed with open-ended stud-receiving grooves and having a shape such that displacement of the slide in the receptacle in a first direction causes the studs to move along the grooves from the open ends thereof, and displacement in the opposite direction forces the studs out of the grooves.

Connectors of the above type are often referred to as assisted insertion and extraction connectors.

They are used in particular in locations that are difficult to access. They enable the connector to be mated together by placing the plug on the receptacle while the slide is in a withdrawn position, and by then pushing in the slide. A drawback of many prior connectors of that kind is the risk of pulling the slide too far when it is desired to uncouple the connector. The slide may then escape from the receptacle and be lost or difficult to find.

SUMMARY OF THE INVENTION

An object of the invention is to provide an improved electrical connector of the above-defined type; it is a more specific object to reduce the risk of loss of the slide.

To this end, the invention provides a connector wherein the slide includes resilient retaining lugs that project outwardly from the slide when at rest, and cutouts that are elongate in the slide displacement direction are formed in the side wall of the receptacle to receive the lugs and are of a length enabling full insertion of the slide but preventing full extraction of the slide, the resilient retaining lugs being of a shape such that the force required for pulling the slide out of the receptacle is much greater than the force required for inserting it into the receptacle.

In a typical embodiment of the invention, the slide is further provided with resilient locking tabs located to be received in notches formed in the side walls, when the slide is in its fully inserted position. The tabs thus provide resilient locking preventing possible displacement of the slide in the event of vibration. The notches may pass through the slide walls so that the ends of the tabs can be seen in the notches when the slide is fully pushed home, thereby providing a visual check.

The invention also seeks to provide a connector that is reversible i.e., whose slide may be inserted from either side of the receptacle. To achieve this result, according to another aspect of the invention that is usable independently of the preceding aspect but that is advantageously used in conjunction therewith, the studs comprise at least one pair of studs placed in a mid-plane of the plug, the grooves of the slide including at least one pair of grooves designed to receive the studs, and the cutouts in the receptacle are symmetrical about the mid-plane of the receptacle. If resilient locking tabs are provided, then two pairs of notches are provided for receiving them and are disposed symmetrically about the mid-plane of the receptacle.

In an embodiment enabling the plug to be inserted and extracted more steadily, the plug includes two pairs of studs, one of the pairs being situated in the middle of the plug and the other close to one end, and the slide includes two pairs of grooves of corresponding shape.

The grooves, which constitute insertion and extraction camming slide paths or ramps, advantageously have respective end portions that extend substantially parallel to the displacement direction of the slide, i.e., perpendicular to the insertion and extraction direction. In this way, vibration along the plug insertion and extraction direction does not generate forces tending to displace the slide.

The invention will be better understood on reading the following description of a particular embodiment given as an example, together with variants.

BRIEF DESCRIPTION OF THE DRAWINGS

The description refers to the accompanying drawings.

FIG. 3, similar to FIG. 2, shows the slide fully pushed home;

FIG. 4 is a cross-sectional view along a mid-plane through a connector constituting a modification of the connector shown in FIGS. 1 to 3; and FIG. 5 is a detailed view showing a modified embodiment of the resilient locking tabs.

DETAILED DESCRIPTION OF PREFERRED EMBODIMENTS

Figure 1:
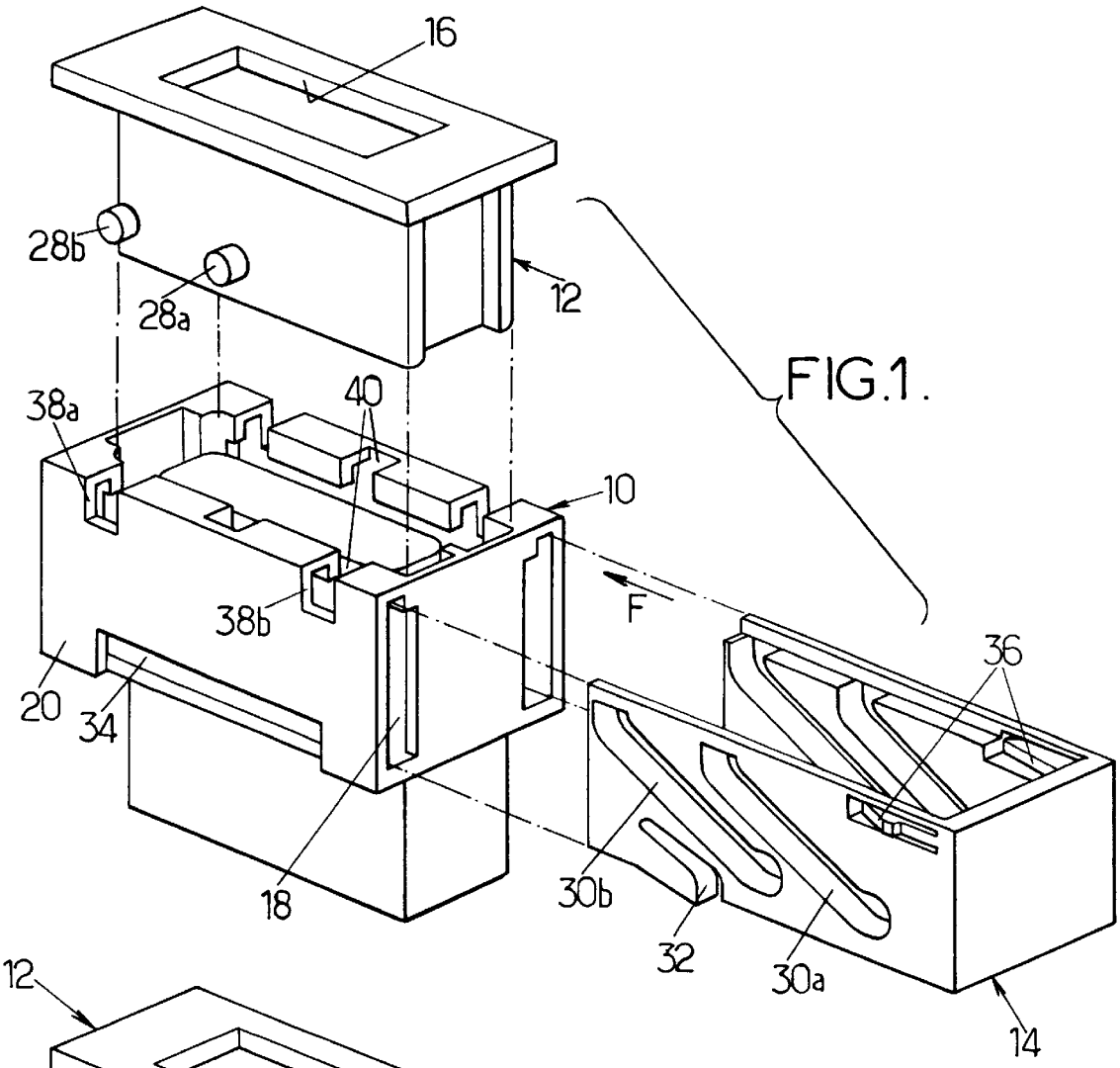
FIG. 1 is an exploded perspective view of a connector.
Figure 2:
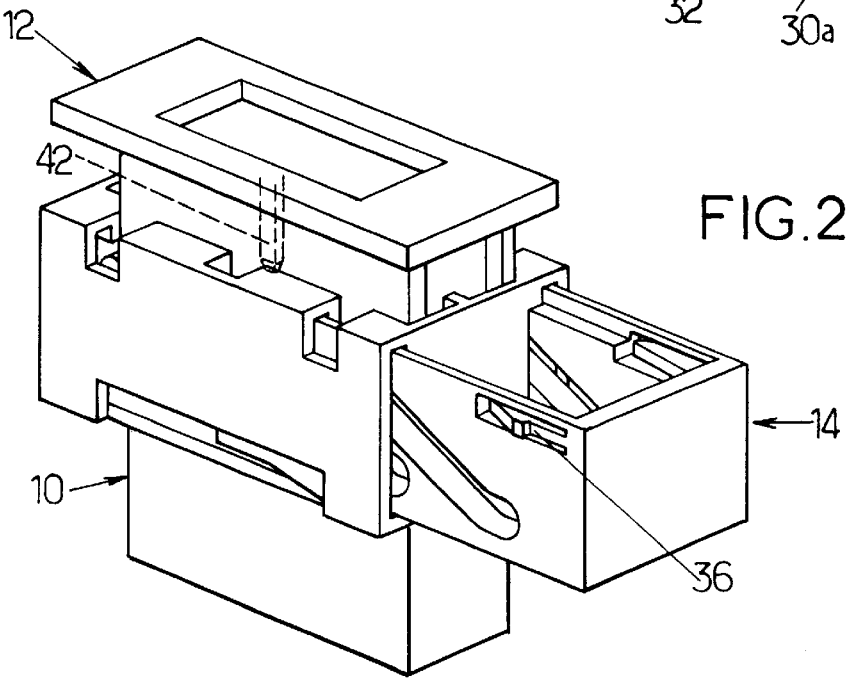
FIG. 2, similar to FIG. 1, shows the connector with the slide in its position for receiving the studs in the open ends of its grooves.

The connector shown in FIGS. 1 to 3 comprises two housings, which may be considered as constituting a receptacle 10 and a plug 12. The terms "plug" and "receptacle" are used for convenience and do not imply in any way that the receptacle constitutes a fixed element. The connector also includes a U-shaped slide 14 that is insertable in the receptacle 10.

The three component elements 10, 12 and 14 are generally made of plastic material reinforced with fillers, and made by molding. The plug 12 and the receptacle 10 are designed to receive electrical contacts (not shown in FIG. 1). For example, the contacts in the receptacle 10 may be permanently secured to the receptacle, e.g., by molding the material from which the receptacle is made onto the contacts. As shown, the plug includes a compartment 16 for receiving a contact-carrying wafer. Fastening fingers may be provided to hold the wafer once it has been inserted.

The receptacle 10 is of elongate rectangular cross-section and, in its longer direction, has two parallel passages 18 enabling the slide 14 to move in the direction indicated by arrow F (FIG. 1) and in the opposite direction, while being retained against movement in the plug insertion and extraction direction which is orthogonal to F. These passages are defined by an internal portion of the receptacle 10 and by two parallel side walls 20. They guide the slide while it is moving.

The plug 12 is also rectangular in cross-section. Its outside face is smooth for the most part and its size is such that it can be engaged in the receptacle.

The slide 14 and the plug 12 include means that cooperate to cause the plug to be inserted in response to movement of the slide 14 in the direction of arrow F, and to cause the plug to be extracted during displacement in the opposite direction.

In the example shown, the means carried by the plug are constituted by two pairs of studs 28*a* and 28*b* that project outwards, on both sides of the plug. The presence of two pairs of studs ensures better guidance of the plug during insertion and extraction thereof. When it is desired that the connector be reversible, as shown, one pair of studs 28*a* may be placed on the mid-plane of the plug, while the studs 28*b* are close to one end of the plug.

The studs 28*a* and 28*b* are designed to engage in grooves 30*a*, 30*b* formed in the slide 14 and having respective ends opening out into the edge of the slide that faces towards the plug. Each of these grooves has an entry length parallel to the plug insertion direction to facilitate engaging the studs 28*a*, 28*b*. This entry length segues into an oblique length constituting the major portion of the total length of the groove. The closed end portion of each groove extends parallel to the displacement direction F so that attractive force on the plug does not tend to expel the slide 14.

Means are provided for retaining the slide with considerable force once the slide has been pushed into the receptacle from a predetermined, which position is advantageously the position in which the studs 28*a*, 28*b* register with the open ends of the grooves 30*a*, 30*b*.

In the example shown, the retaining means are constituted by resilient retaining lugs 32 constituted by portions cut out from the side wall of the slide and projecting outwards when the lugs are free. The lugs are shaped to be retained in cutouts 34 provided in the receptacle 10. The resilient lugs extend in such a direction that the slide is easily inserted with the lugs then bending resiliently, but that extraction is made difficult or practically impossible because the free ends of the lugs come into abutment against the end faces of the respective cutouts.

The connector shown in FIGS. 1 to 3 further includes resilient locking tabs 36 which hold the slide resiliently in place once it has been fully inserted. In the embodiment shown, these tabs are in form of longitudinally extending harpoons (extending parallel to direction F) and they are constituted by respective portions cut out from the slide. When the slide is pushed fully into the receptacle, end catches of the tabs 36 engage in notches 38*a* or 38*b* in the receptacle depending on the insertion direction of the slide 14. The notches 38*a*, 38*b* may be constituted by through holes so as to enable full engagement to be checked visually.

Operation of the connector will now be described.

The slide 14 is initially inserted into the receptacle 10 until the lugs 32 are retained in the cutouts 34, and is then moved backwards until the lugs are in abutment. The cutouts are advantageously sized so that, in the abutment position, the open ends of the grooves are in register with the insertion path of the lugs. The plug 12 can then be placed on the receptacle 10, which may have entry guideways for the studs. In the example shown in FIGS. 1 to 3, the guideways comprise middle guideways 40 designed to receive the studs 28*a*, and notches 38*a* or 38*b* (depending on the side through which the slide is inserted). When the plug is in this position, its contacts, such as the contact 42 shown in FIG. 2, are not yet electrically connected with the contacts in the receptacle. When the slide 14 is then pushed to the position shown in FIG. 3, in which its cross member may abut against the receptacle, the plug is forced fully into the receptacle. At the end of the slide displacement, the tabs 36 lock the slide resiliently, as shown in FIG. 3.

FIG. 4, where elements corresponding to those of FIG. 1 to 3 are designated by the same reference numerals, shows a modified embodiment with notches 38 for receiving the tabs 36 which are constituted by holes that are separate from the guideways.

Finally, FIG. 5 shows a variant of the locking tabs particularly suitable for use in the embodiment of FIG. 4. The tabs are constituted by triangular portions 44 cut out in the slide and having projecting catches 46 for engaging in the notches 48 that are separate from the entry guideways for the studs.

I claim:

1. A rectangular electrical connector comprising:

a receptacle receiving first electrical contacts, having two side walls that define two parallel passages extending in a longer direction of the receptacle;

a plug receiving second contacts for cooperation with said first contacts, the plug being displaceable with respect to the receptacle in an insertion and extraction direction, said plug having studs projecting orthogonally to the insertion and extraction direction; and a single U-shaped slide for forced insertion and extraction of the plug, the slide being arranged for sliding along the passages orthogonally to the insertion and extraction direction, being formed with open-ended stud-receiving grooves and having a shape such that displacement of the slide in the receptacle in a first direction causes the studs to move along the grooves from open ends thereof, and displacement in the opposite direction forces the studs out of the grooves;

wherein the slide includes resilient retaining lugs that project outwardly from the slide when at rest, and cutouts that are elongate in the slide displacement direction are formed in the side wall of the receptacle to receive the lugs and are of a length enabling complete insertion of the slide but preventing full extraction of the slide, the resilient retaining lugs being of a shape such that a force required for pulling the slide out of the receptacle is much greater than a force required for inserting the slide into the receptacle.

2. A connector according to claim 1, wherein the slide is further formed with a pair of resilient locking tabs located to be received in notches formed in the side walls when the slide is in a fully inserted position.

3. A connector according to claim 2, wherein said notches pass through the side walls, whereby the ends of the tabs can be seen in the notches when the slide is fully inserted.

4. A connector according to claim 2, wherein said studs comprise at least one pair of studs placed in a mid-plane of the plug, said grooves of the slide including at least one pair of grooves designed to receive said one pair of studs, and said cutouts in the receptacle are symmetrical about the mid-plane of the receptacle.

5. A connector according to claim 4, wherein there are two pairs of said notches which are disposed symmetrically with respect to a mid-plane of the receptacle at locations such that one or the other of said two pairs of said notches receive said locking tabs depending upon in which one of the two opposite directions the slide is inserted.

6. A connector according to claim 4, wherein said plug includes two pairs of said studs, one of the pairs being situated in a middle portion of the plug and the other pair being situated close to one end of the plug, and said slide includes two pairs of grooves of a shape mating with said studs.

7. A rectangular electrical connector comprising:

a receptacle having passages for receiving first electrical contacts, having two side walls that define two parallel passages extending in a longer direction of the receptacle throughout the receptacle;

a plug having passages for receiving second contacts for cooperation with the first contacts, the plug being displaceable with respect to the receptacle in an insertion and extraction direction, said plug having at least one pair of studs projecting orthogonally to the insertion and extraction direction, placed in a mid-plane of the plug;

a single U-shaped slide for forced insertion and extraction of the plug, the slide being arranged for sliding along the passages orthogonally to the insertion and extraction direction, being formed with at least one pair of open-ended stud-receiving grooves having a shape such that displacement of the slide in the receptacle in a first direction causes the studs to move along the grooves from the open ends thereof, and displacement in the opposite direction forces the studs out of the grooves;

wherein the slide is further formed with a pair of resilient retaining lugs that project outwardly from the slide when at rest; and wherein cutouts that are elongate in the slide displacement direction and symmetrical about the mid-plane of the receptacle are formed in the side walls of the receptacle to receive the lugs and are of a length enabling full insertion of the slide, but preventing full extraction of the slide, the resilient retaining lugs being of a shape such that the force required for pulling the slide out of the receptacle is much greater than the force required for inserting the slide into the receptacle.

8. A receptacle according to claim 7, wherein said slide is formed with a pair of resilient locking tabs, and said side walls of said receptacle are formed with two pairs of notches which are disposed symmetrically with respect to a mid-plane of the receptacle so located that one of said pairs of notches receives said tabs when the slide is fully inserted.

9. A connector according to claim 8, wherein said plug includes an additional pair of said studs close to one end of the plug and said slide includes an additional pair of grooves of a shape mating with said additional studs.

10. A rectangular electrical connector comprising:

a receptacle accommodating first electrical contacts, having two side walls that define two parallel passages extending in a longer direction of the receptacle;

a plug accommodating second contacts for cooperation with said first contacts, the plug being displaceable with respect to the receptacle in an insertion and extraction direction orthogonal to said longer direction, said plug having four studs projecting orthogonally to the insertion and extraction direction, two of said studs being located on each side of said plug;

a single U-shaped slide for forced insertion and extraction of said plug, said slide being arranged for sliding movement along said passages orthogonally to the insertion and extraction direction, being formed with open-ended stud-receiving mutually parallel grooves and having a shape such that displacement of the slide in the receptacle in a first direction causes the studs to move along the grooves from open ends thereof and displacement in the opposite direction forces the studs out of the grooves;

wherein the single slide includes resilient retaining lugs that project outwardly from the slide when at rest, and wherein cutouts that are elongate in the slide displacement direction are formed in the side walls of the receptacle to receive the lugs and are of a length enabling complete insertion of the slide but preventing full extraction of the slide, the resilient retaining lugs being of a shape such that a force required for pulling the slide out of the receptacle is much greater than a force required for inserting the slide into the receptacle.

11. A connector according to claim 10, wherein the slide is further formed with resilient locking tabs located to be received in notches formed in the side walls when the slide is in its fully inserted position.

12. A connector according to claim 11, wherein:

said studs are distributed into one pair of studs placed in a mid plane of the plug and another pair of studs located away from said midplane;

said grooves of the slide consist of one pair of grooves arranged to receive said one pair of studs and another pair of grooves arranged to receive said another pair of studs; and said notches in the receptacle are symmetrically located about said midplane for receiving said locking tabs whatever the direction of insertion of said slide into the receptacle.

* * * * *